US009663907B2

(12) United States Patent
Rainey

(10) Patent No.: US 9,663,907 B2
(45) Date of Patent: May 30, 2017

(54) PRECAST TRAFFIC BARRIER ATOP RETAINING WALL SYSTEM

(71) Applicant: EARTH REINFORCEMENT TECHNOLOGIES, LLC., Woodstock, GA (US)

(72) Inventor: Thomas L. Rainey, Marietta, GA (US)

(73) Assignee: EARTH WALL PRODUCTS, LLC, Marietta, GA (US)

( * ) Notice: Subject to any disclaimer, the term of this patent is extended or adjusted under 35 U.S.C. 154(b) by 0 days.

(21) Appl. No.: 14/410,192

(22) PCT Filed: Jun. 27, 2013

(86) PCT No.: PCT/US2013/048286
§ 371 (c)(1),
(2) Date: Dec. 22, 2014

(87) PCT Pub. No.: WO2014/004892
PCT Pub. Date: Jan. 3, 2014

(65) Prior Publication Data

US 2015/0337509 A1 Nov. 26, 2015

Related U.S. Application Data

(60) Provisional application No. 61/665,545, filed on Jun. 28, 2012.

(51) Int. Cl.
*E01F 15/00* (2006.01)
*E01F 15/08* (2006.01)
*E02D 29/02* (2006.01)

(52) U.S. Cl.
CPC ..... *E01F 15/088* (2013.01); *E01F 15/083* (2013.01); *E02D 29/0266* (2013.01)

(58) Field of Classification Search
CPC ... E01F 15/088; E01F 15/083; E02D 29/0266
(Continued)

(56) References Cited

U.S. PATENT DOCUMENTS 952,645 A * 3/1910 Smith ..... E02D 29/0266 405/285
2,420,228 A * 5/1947 Condon ..... E02B 3/066 405/286

(Continued)

FOREIGN PATENT DOCUMENTS

CN 2635728 Y 8/2004

OTHER PUBLICATIONS

"Median Barrier Wall for Superelevated Sections or for Variable Roadway Profile Grades." FDOT Design Standards, Jan. 1, 2011 [technical document]; p. 1, schematic labeled cantilever wall superevelated section; Design Criteria.

(Continued)

*Primary Examiner* — Raymond W Addie
(74) *Attorney, Agent, or Firm* — Thomas | Horstemeyer, LLP

(57) ABSTRACT

A roadside barrier to sit on top of a retaining wall to provide impact resistance to vehicular traffic. The precast concrete traffic barrier unit is designed to have a counterweight from soil backfill on the horizontal stem portion of the precast unit that acts to resist overturning pressures from vehicle impact on the precast traffic barrier portion which extends above the roadway surface. The horizontal stem is an exemplary designed triangular in shape to capture more of the backfill soil than typically what soil backfill rest directly above the horizontal stem or counterweight portion. Therefore, the triangular horizontal stem with its arching effect between adjacent units will allow more of the soil backfill to resist impact loading and reduce the amount of concrete needed to (Continued)

provide adequate vehicle restraint protection. An alignment seat locks the traffic barrier unit to the retaining wall below.

12 Claims, 6 Drawing Sheets

(58) Field of Classification Search
USPC ..... 404/6, 9; 14/78
See application file for complete search history.

(56) References Cited

U.S. PATENT DOCUMENTS

| | | | | | |
|---|---|---|---|---|---|
| 3,195,312 | A | | 7/1965 | Rumsey | |
| 3,225,548 | A | * | 12/1965 | Homer | E02D 29/0266 405/286 |
| 3,877,236 | A | * | 4/1975 | O'Neill | E02D 29/0216 405/273 |
| 4,000,622 | A | * | 1/1977 | Chiaves | E02D 29/0266 405/286 |
| 4,059,362 | A | | 11/1977 | Smith | |
| 4,126,001 | A | * | 11/1978 | Shimada | E02D 29/0266 405/273 |
| 4,372,091 | A | * | 2/1983 | Brown | E04B 2/46 52/592.6 |
| 4,494,892 | A | | 1/1985 | Wojciechowski et al. | |
| 4,684,287 | A | * | 8/1987 | Wojciechowski | E01F 15/0476 404/6 |
| 4,684,294 | A | * | 8/1987 | O'Neill | E02D 29/0266 405/273 |
| 5,066,169 | A | * | 11/1991 | Gavin | E02D 29/025 405/262 |
| 5,131,786 | A | | 7/1992 | House | |
| 5,468,098 | A | * | 11/1995 | Babcock | E02D 29/0225 405/262 |
| 5,471,811 | A | | 12/1995 | House | |
| 5,492,438 | A | | 2/1996 | Hilfiker | |
| 5,688,078 | A | * | 11/1997 | Hammer | E02D 29/0266 405/262 |
| 6,539,684 | B1 | * | 4/2003 | Graham | E02D 29/025 405/284 |
| 6,675,547 | B1 | * | 1/2004 | Golcheh | E02D 29/0216 405/284 |
| 7,044,687 | B1 | | 5/2006 | Carey | |
| 7,073,984 | B2 | * | 7/2006 | Carey | E02D 29/0266 405/286 |
| 7,845,885 | B2 | * | 12/2010 | Jaecklin | E02D 29/025 405/273 |
| 8,568,057 | B2 | * | 10/2013 | Rodriguez | E01F 15/083 256/13.1 |
| 9,187,869 | B2 | * | 11/2015 | Rainey | E01F 15/083 |
| 2003/0213203 | A1 | | 11/2003 | Bott | |
| 2006/0104724 | A1 | | 5/2006 | Carey et al. | |
| 2009/0148242 | A1 | * | 6/2009 | Collet | B28B 7/0029 405/286 |
| 2011/0318100 | A1 | | 12/2011 | Rainey | |

OTHER PUBLICATIONS

International Search Report and Written Opinion; dated Nov. 22, 2013.
Chinese Office Action in co-pending, related Chinese application No. 201380033839.9, mailed Oct. 28, 2015.
Japanese Office Action in co-pending, related Japanese application No. 2015-520525 mailed Feb. 2, 2016.
Extended European Search Report in co-pending, related EP Application No. 13808589.9, mailed May 4, 2016.
Australian Examination Report No. 2 in co-pending related Australian Patent Application No. 2013284409, mailed Feb. 6, 2017.
European Office Action in co-pending, related EP Application No. 13 808 589.9, mailed Feb. 10, 2017.

* cited by examiner

PRECAST TRAFFIC BARRIER ATOP RETAINING WALL SYSTEM

CROSS-REFERENCE TO RELATED APPLICATION

This application is the 35 U.S.C. §371 national stage of, and claims priority to and the benefit of, PCT application PCT/US2013/048286, filed Jun. 27, 2013, which claims priority to and the benefit of U.S. Application No. 61/665,545, filed on Jun. 28, 2012, herein incorporated by reference in their entireties.

BACKGROUND

Conventional concrete earth retaining walls are commonly used for architectural, site development and roadway/highway construction applications. When roadways are located above or rest on top of the completed earth retaining wall, a traffic barrier is required to prevent vehicles from falling off of the retaining wall. Therefore, a traffic barrier is required to contain the impact from vehicles to keep them from falling over the retaining wall. The objective of the current invention is to minimize the concrete required for this purpose of using an exemplary shaped counterweight stem to capture more of the soil backfill weight located behind the earth retaining wall above the stem location to act as a counterweight and prevent barrier movement.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
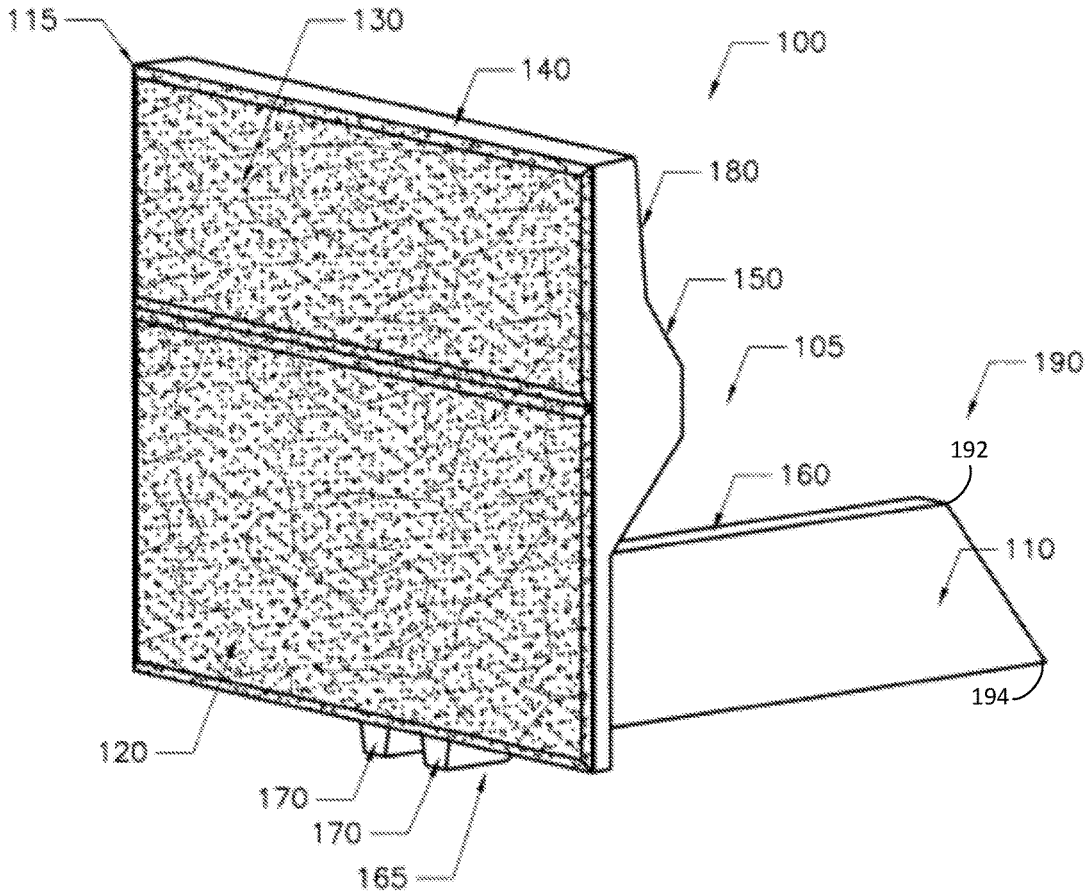
FIG. 1 is a view of the exemplary precast traffic barrier in accordance various embodiments of the disclosure.

Disclosed herein are different views of the exemplary precast traffic barrier related to the siting above an earth retaining wall to prevent traffic from falling over the earth retaining wall. Reference will now be made in detail to the description of the embodiments as illustrated in the drawings. Like reference numbers indicate like parts throughout the several views.

When roadways, driveways, or vehicle access is planned above an underlying earth retaining wall, a traffic barrier to prevent traffic from falling over the walls leading edge is required. Traditionally, a guard rail or poured in place concrete traffic barrier is installed above the underlying earth retaining wall to contain vehicles traveling on the planned drive isle or roadway above the underlying earth retaining wall. The exemplary invention is to expedite installation of the traffic barrier by making it a part of the earth retaining wall system where the traffic barriers can act as the top row of the modular precast retaining wall system and provide resistance to overturning by using the backfill soil weight resting on the horizontal cantilever triangular stem. The downward pressure of the soil backfill beside and on top of the horizontal protruding stem provides the resisting pressure to have the exemplary precast traffic barrier act as a cantilever foundation with a vertical wall and resist impact loads from vehicles impacting the portion of the precast traffic barrier extending above grade.

Generally speaking, the portion of the precast traffic barrier extending above grade has a geometry and dimension defined by various state Department of Transportations that are standard or uniform throughout all traffic barriers installed along roadways, highways, and planned drive isles of the respective states. Therefore, the geometry of the vertical portion of the precast traffic barrier that extends above the roadway grade may vary from state to state.

Referring to FIG. 1, the exemplary precast traffic barrier 100 has a front portion 115, a horizontal stem 190, and an alignment seat 165. The front portion 115 has an above-grade front surface 130, a below-grade front surface 120, a top surface 140, a rear surface 180, and a slanted portion 150. The above-grade front surface 130 extends vertically above roadway grade and the below-grade front surface 120 extends vertically below roadway grade. The below-grade front surface 120 comprises the upper portion of the underlying earth retaining wall. The top surface 140 of the front portion 115 is typically 32 to 36 inches above the roadway or driveway surface elevation. The rear surface 180 of the front portion 115 extends above grade. Vehicular impact would occur against the rear surface 180 as well as the slanted portion 150. The overall stability of the exemplary precast traffic barrier 100 is prevented from overturning by a counterweight from backfill soil resting beside and above the horizontal stem 190. A protrusion 110 of the rear stem helps capture the surrounding backfill soils weight to add resisting force by means of downward weight on the horizontal stem 190. The horizontal stem 190 extends from a top surface 192 to a bottom surface 194. The vertical center portion 160 of the horizontal stem 190 is approximately 30 inches below the drive or roadway grade to allow the installation of utilities and pavement section not obscured by the precast traffic barrier 100 piece or unit. To keep the exemplary precast traffic barrier from sliding on top of the retaining wall, an alignment seat 165 comprising aligning elements 170 extend below the exemplary precast traffic barrier 100 to lock into the top concrete precast unit of the earth retaining wall. The aligning elements 170 may comprise, for example, two protruding lugs.

Figure 2:
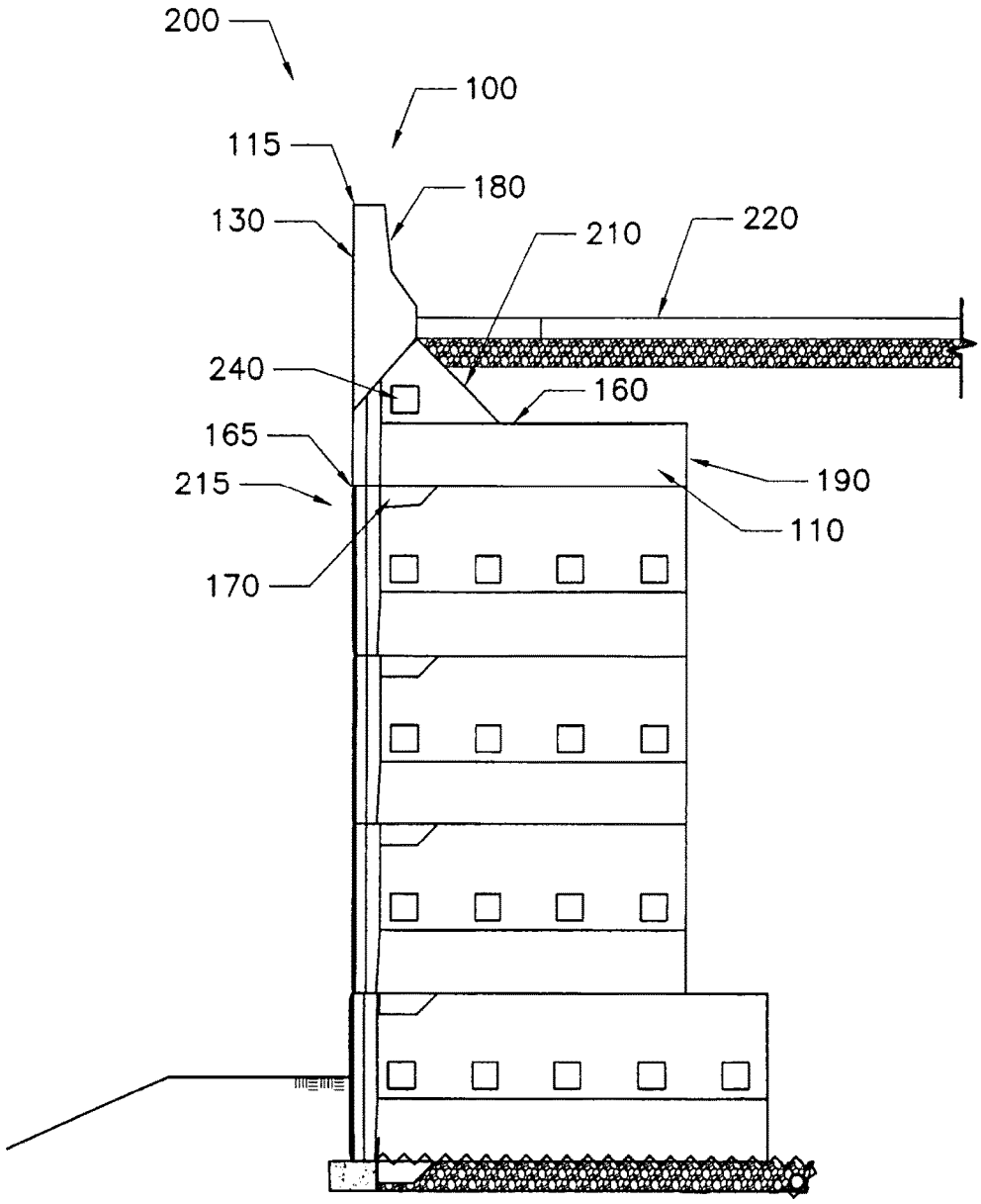
FIG. 2 is a cross sectional view of an earth retaining wall with the exemplary precast traffic barrier sitting on top of an earth retaining wall in accordance various embodiments of the disclosure.

FIG. 2 shows a cross section 200 of the elevated roadway grade 220 sitting on top of the earth retaining wall. The horizontal stem 190 of the exemplary precast traffic barrier 100 sits well below the pavement grade 220 to prevent interference. For installation of the exemplary precast traffic barrier 100, a square hole 240 is cast into the exemplary precast traffic barrier 100 to facilitate lifting and hoisting into place. A diagonal portion 210 is required to transfer the downward cantilever pressure on the horizontal stem 190 to the front portion 115 of the exemplary precast traffic barrier 100 to prevent impact on the rear surface 180 of the barrier-facing vehicular traffic. The exemplary precast traffic barrier 100 is aligned with the underlying earth retaining wall by the alignment seat 165, which is engaged to a top portion of the underlying earth retaining wall.

Figure 3:
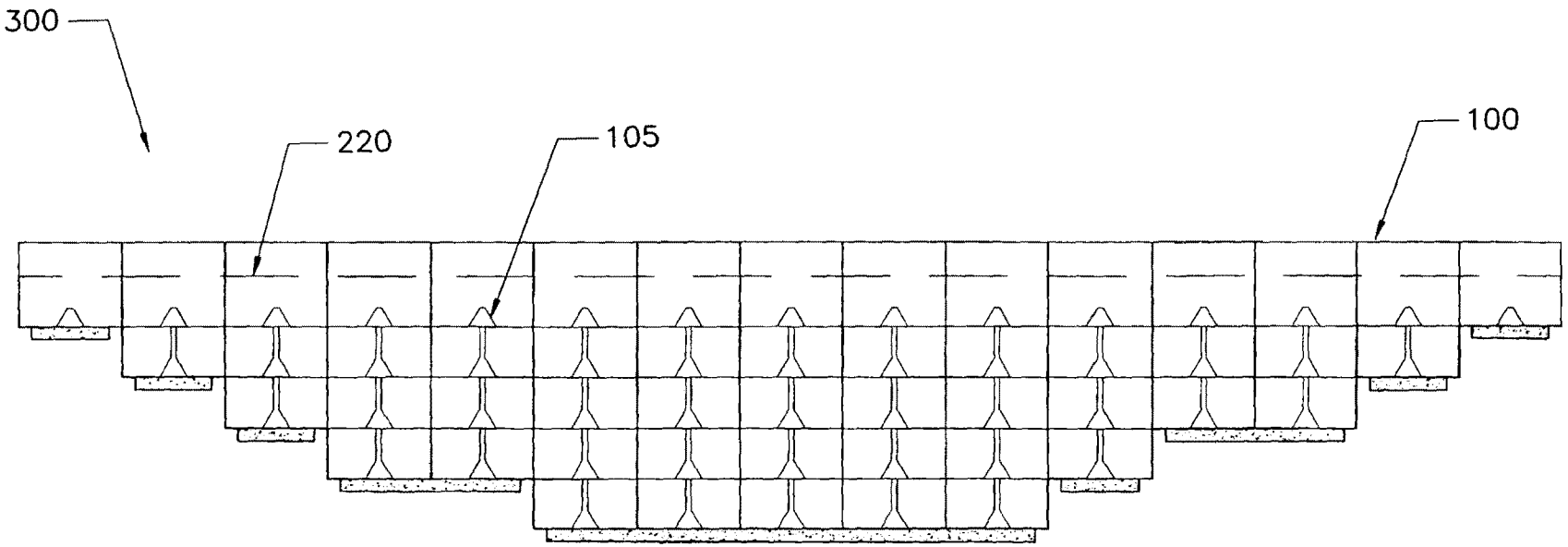
FIG. 3 is an elevation view of an earth retaining wall with the exemplary precast traffic barrier making up the top row of precast concrete units in accordance various embodiments of the disclosure.

FIG. 3 shows an elevation view 300 of the front face of the earth retaining wall, the exemplary precast traffic barrier 100 makes up the top row of the concrete earth retaining wall to complete or top out the earth retaining wall soil retention requirements. The grade of the proposed roadway 220 is below the barrier portion of the precast traffic barrier 100 but above the horizontal cantilever triangular stem 105 of the precast traffic barrier 100.

Figure 4:
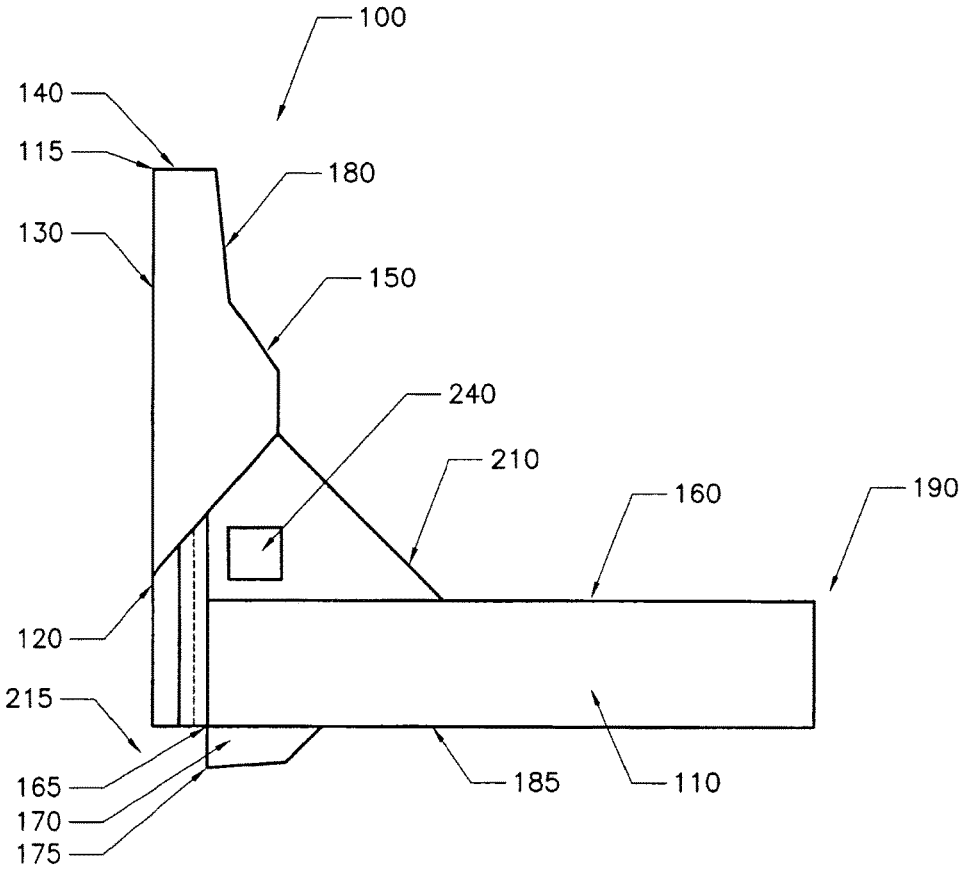
FIG. 4 is a side view of the exemplary precast traffic barrier in accordance various embodiments of the disclosure.

In FIG. 4, the exemplary precast traffic barrier 100 is shown. The aligning elements 170 extend below the bottom of the horizontal stem 190 to lock into the earth retaining wall system below. The aligning elements 170 extend downwardly from the bottom surface 185 of the protrusion 110 of the horizontal stem 190 and rearward along the protrusion 110 of the horizontal stem 190. The below-grade front surface 120 of the precast traffic barrier 100 is in vertical alignment with the underlying retaining wall face and the front face 175 of the aligning element 170 to complete the earth retaining wall vertical plane alignment. For example, the aligning elements 170 may be aligned in a parallel fashion with the rear surface 180 of the front portion 115.

Figure 5:
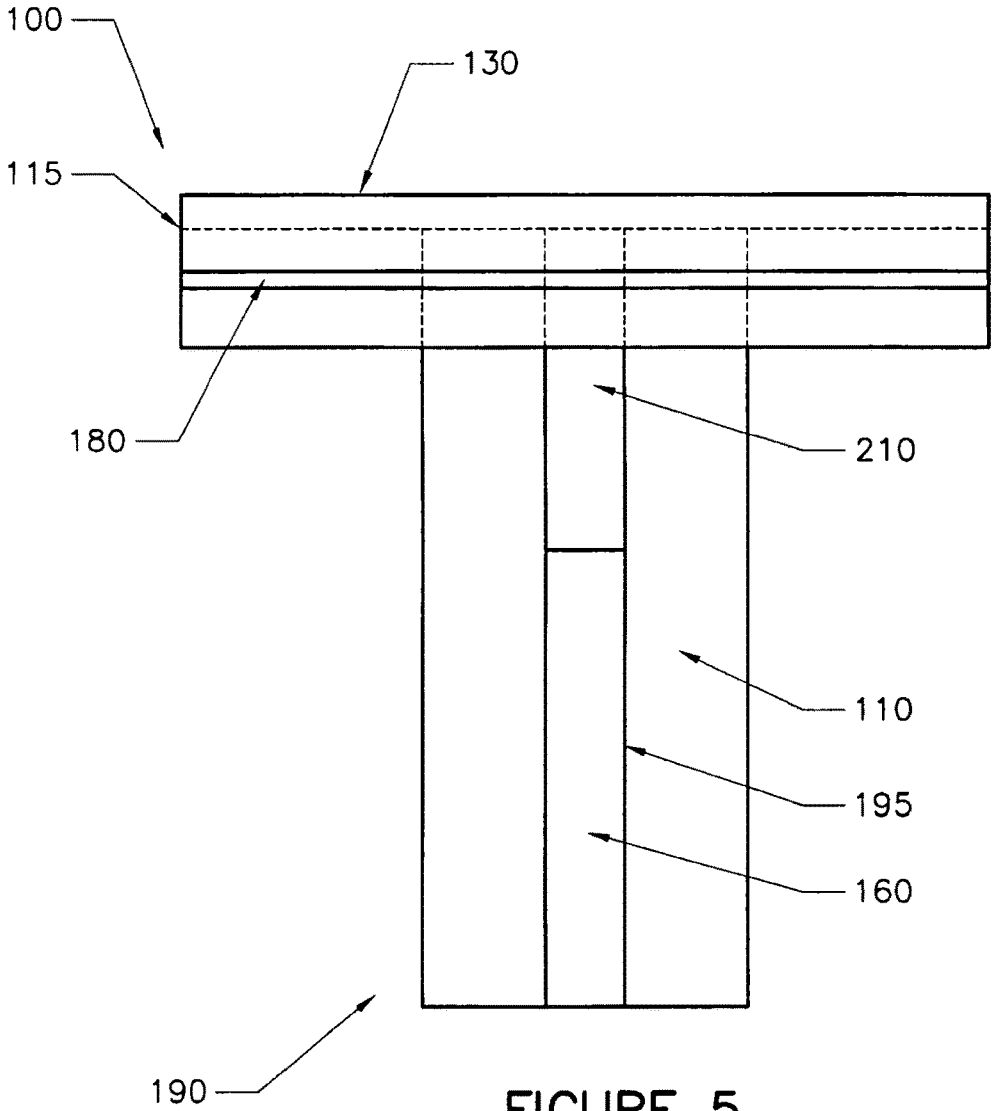
FIG. 5 is a top view of the exemplary precast traffic barrier in accordance various embodiments of the disclosure.

FIG. 5 shows the top view to illustrate the triangular protrusions 110 of the horizontal stem 190 that cover approximately 50% of the overall counterweight area of backfill soil that is available to provide weight for overturning resistance. The triangular protrusions 110 allow the reduced horizontal coverage area and hence save precast concrete area and volume. The triangular protrusions 110 extend outwardly from the top side 195 of the vertical center portion 160 of the horizontal stem 190 and slope downwardly from the top surface 192 of the horizontal stem 190 to the bottom surface 194 of the horizontal stem 190. The diagonal portion 210 connects the rear surface 180 with the vertical center portion 160 of the horizontal stem 190.

Figure 6:
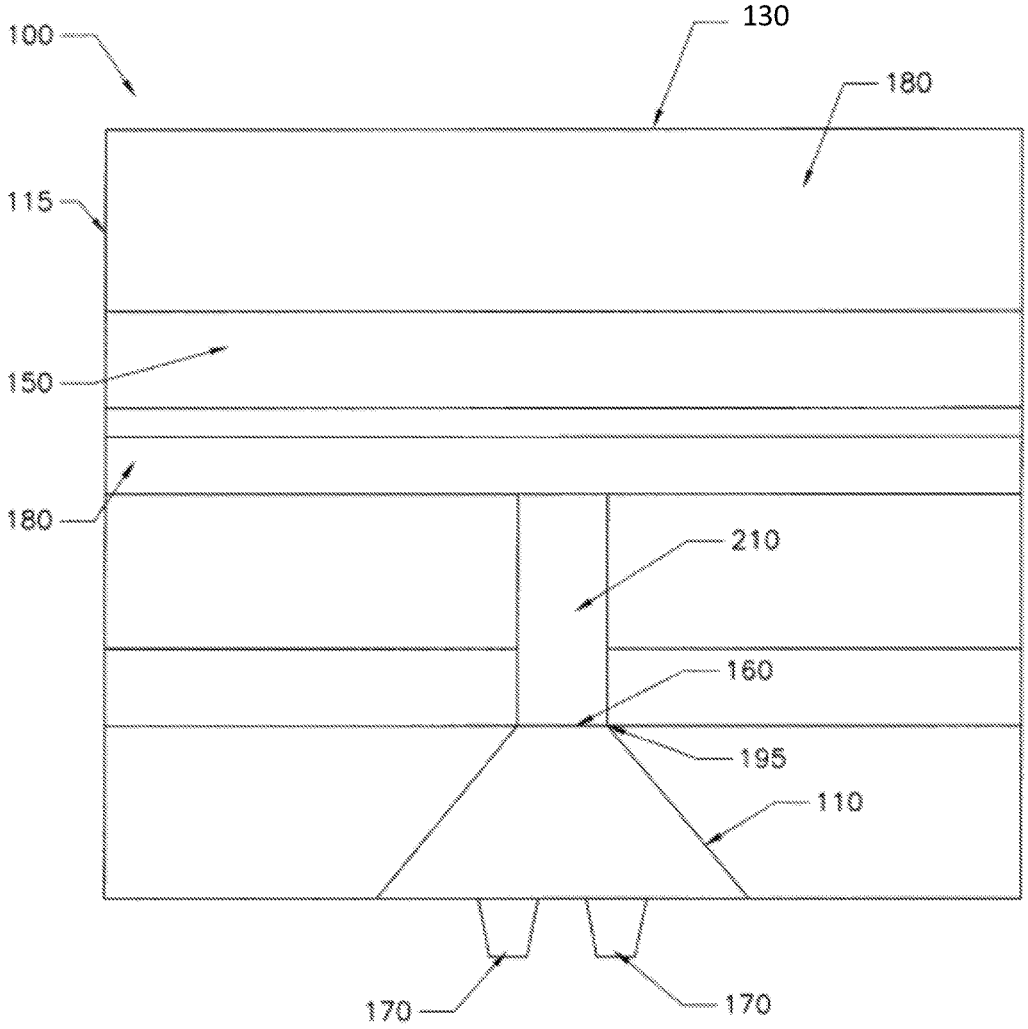
FIG. 6 is a back view of the exemplary precast traffic barrier in accordance various embodiments of the disclosure.

FIG. 6 is a rear view of the exemplary precast traffic barrier 100 which shows the diagonal portion 210 connecting the vertical center portion 160 of the horizontal stem 190 up to the vertical rear surface 180 of the front portion 115 of the precast traffic barrier 100.

It should be emphasized that the above described invention of the present disclosure is to implement an arching effect within the earth retaining wall backfill soils by the triangular stem to take advantage of the soil backfill vertical weight to provide resisting force from horizontal vehicular impact on the portion of the stem above the drive isle or roadway grade. The dimensions of the portion of the barrier above grade may vary depending upon various Department of Transportation guidelines for impact barriers along roadways.

It should be emphasized that the above-described embodiments of the present invention, particularly, any "preferred" embodiments, are merely possible non-limiting examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention.

Therefore, at least the following is claimed:

1. A precast traffic barrier configured for assembly on a top portion of an underlying concrete earth retaining wall to prevent a vehicle traveling on a roadway from falling over the underlying concrete earth retaining wall, the precast traffic barrier comprising:

a front portion comprising an above-grade front surface, a below-grade front surface, a rear surface, a top surface, a bottom surface, and a slanted portion, the slanted portion extending outwardly from the front portion and slanting downwardly from a portion of the rear surface;

a horizontal stem extending outwardly from the rear surface of the front portion, the horizontal stem comprising a vertical center portion, a left triangular protrusion extending outwardly from a left side of the vertical center portion, and a right triangular protrusion extending outwardly from a right side of the vertical center portion, the left triangular protrusion and the right triangular protrusion sloping downwardly from the top surface of the horizontal stem to a bottom surface of the horizontal stem;

a diagonal portion connecting the slanted portion of the front portion to the horizontal stem, wherein the diagonal portion traverses between the slanted portion of the front portion and the top surface of the horizontal stem, and wherein the diagonal portion transfers a cantilever pressure on the horizontal stem to the front portion; and an alignment seat extending along at least a portion of the horizontal stem, the alignment seat engaged with the top portion of the underlying earth retaining wall.

2. The precast traffic barrier of claim 1, wherein the diagonal portion is nonparallel to the horizontal stem.

3. The precast traffic barrier of claim 1, wherein the alignment seat engages at least:

the rear surface of the front portion;

a bottom surface of the left triangular protrusion; and a bottom surface of the right triangular protrusion.

4. The precast traffic barrier of claim 1, wherein the alignment seat comprises:

a left aligning element extending rearward along at least a portion of the left triangular protrusion and downwardly from a bottom surface of the left triangular protrusion; and a right aligning element extending rearward along at least a portion of the right triangular protrusion and downwardly from a bottom surface of the right triangular protrusion.

5. The precast traffic barrier of claim 4, wherein the left aligning element comprises a left protruding lug and the right aligning element comprises a right protruding lug.

6. The precast traffic barrier of claim 4, wherein a front face of the left aligning element is parallel with the rear surface of the front portion and a front face of the right aligning element is parallel with the rear surface of the front portion.

7. The precast traffic barrier of claim 1, wherein the diagonal portion is nonparallel to the underlying concrete earth retaining wall.

8. A precast traffic barrier configured for assembly on a top portion of an underlying concrete earth retaining wall, the precast traffic barrier comprising:

a front portion comprising an above-grade front surface, a below-grade front surface, a rear surface, a top surface, a bottom surface, and a slanted portion, the slanted portion extending outwardly from the front portion and slanting downwardly from a portion of the rear surface;

a horizontal cantilever triangular stem extending outwardly from the rear surface of the front portion, the horizontal cantilever triangular stem comprising at least a left triangular protrusion, and a right triangular protrusion wherein:

the left triangular protrusion extends outwardly from a top left side of a vertical center portion of the horizontal cantilever triangular stem and slopes downwardly from a top surface of the horizontal cantilever triangular stem to a bottom surface of the horizontal cantilever triangular stem; and the right triangular protrusion extends outwardly from a top right side of the vertical center portion of the horizontal cantilever triangular stem and slopes downwardly from a top surface of the stem to a bottom surface of the horizontal cantilever triangular stem;

a diagonal portion that traverses between the slanted portion of the front portion and the horizontal cantilever triangular stem and transfers a cantilever pressure on the horizontal cantilever triangular stem to the front portion; and an alignment seat extending along at least a portion of the horizontal cantilever triangular stem, the alignment seat connected to at least:

the top portion of the underlying earth retaining wall;

the rear surface of the front portion;

a bottom face of the left triangular protrusion; and a bottom face of the right triangular protrusion.

9. The precast traffic barrier of claim 8, wherein the alignment seat comprises at least a left lug aligned with the rear surface of the front portion and a right lug aligned with the rear surface of the front portion.

10. The precast traffic barrier of claim 8, wherein the vertical center portion of the horizontal cantilever triangular stem is at least 30 inches below a roadway.

11. The precast traffic barrier of claim 8, wherein the diagonal portion is nonparallel to the horizontal cantilever triangular stem.

12. The precast traffic barrier of claim 8, wherein the diagonal portion is nonparallel to the underlying concrete earth retaining wall.

* * * * *